US010601159B2

(12) United States Patent
Wu et al.

(10) Patent No.: US 10,601,159 B2
(45) Date of Patent: Mar. 24, 2020

(54) ELECTRICAL CONNECTOR CAPABLE OF IMPROVING HIGH FREQUENCY PERFORMANCE

(71) Applicant: LOTES CO., LTD, Keelung (TW)

(72) Inventors: Yong Quan Wu, Keelung (TW); Chin Chi Lin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/251,313

(22) Filed: Jan. 18, 2019

(65) Prior Publication Data

US 2019/0245289 A1 Aug. 8, 2019

(30) Foreign Application Priority Data

Feb. 6, 2018 (CN) ..... 2018 1 0119115

(51) Int. Cl.

| | |
|---|---|
| ***H01R 12/00*** | (2006.01) |
| ***H01R 12/72*** | (2011.01) |
| ***H01R 12/73*** | (2011.01) |
| ***H01R 12/91*** | (2011.01) |
| ***H01R 13/6474*** | (2011.01) |
| ***H01R 13/24*** | (2006.01) |

(Continued)

(52) U.S. Cl.

CPC ..... *H01R 12/721* (2013.01); *H01R 12/732* (2013.01); *H01R 12/91* (2013.01); *H01R 13/2442* (2013.01); *H01R 13/428* (2013.01); *H01R 13/6474* (2013.01); *H01R 12/707* (2013.01)

(58) Field of Classification Search

CPC ..... H01R 23/722; H01R 12/57; H01R 13/41; H01R 13/2442; H05K 7/1084; H05K 7/1069

USPC ..... 439/66, 70, 71, 83, 733.1, 862

See application file for complete search history.

(56) References Cited

U.S. PATENT DOCUMENTS 4,992,056 A * 2/1991 Douty ..... H01R 12/714 439/83
6,908,328 B2 * 6/2005 Lei ..... H01R 13/193 439/342

(Continued)

FOREIGN PATENT DOCUMENTS

CN 2845214 Y 12/2006
CN 200972945 Y 11/2007

(Continued)

*Primary Examiner* — Thanh Tam T Le

(74) *Attorney, Agent, or Firm* — Locke Lord LLP; Tim Tingkang Xia, Esq.

(57) ABSTRACT

An electrical connector for electrically connecting a chip module to a circuit board includes a body, having multiple accommodating slots, and multiple conductive terminals, correspondingly accommodated in the accommodating slots. Each conductive terminal includes: a base portion; an elastic arm, formed by extending upward from the base portion and used for abutting the chip module; a strip connecting portion, formed by extending upward from the base portion and used for being connected to a strip; an extending portion, formed by bending and extending from one side of the base portion, where the extending portion is located below the strip connecting portion and does not interfere with the accommodating slot; and a conducting portion, used for being electrically connected to the circuit board.

20 Claims, 12 Drawing Sheets

(51) Int. Cl.
*H01R 13/428* (2006.01)
*H01R 12/70* (2011.01)

(56) References Cited

U.S. PATENT DOCUMENTS 7,150,632 B2 * 12/2006 Lee ..... H01R 13/2435 439/66
7,429,200 B2 * 9/2008 Lee ..... H01R 13/2442 439/862
7,517,240 B2 * 4/2009 Ma ..... H01R 12/57 439/342
7,563,105 B2 * 7/2009 Liu ..... H01R 13/2492 439/66
7,857,632 B2 * 12/2010 Liu ..... H01R 13/2492 439/66
8,235,734 B2 * 8/2012 Ju ..... H01R 12/57 439/83
8,277,230 B2 * 10/2012 Huo ..... H01R 12/716 439/342
8,323,038 B2 * 12/2012 Jin ..... H01R 12/714 439/66
8,366,453 B2 * 2/2013 Chang ..... H01R 12/58 439/66
8,454,373 B2 * 6/2013 Cheng ..... H01R 12/57 439/66
8,500,458 B2 * 8/2013 Chang ..... H01R 13/2435 439/66
8,708,716 B1 * 4/2014 Ho ..... H01R 12/714 439/83
9,806,444 B1 * 10/2017 Ju ..... H01R 12/585
9,917,386 B1 * 3/2018 Ju ..... H01R 12/52
9,954,312 B1 * 4/2018 Ju ..... H01R 12/707

FOREIGN PATENT DOCUMENTS

CN 100440627 C 12/2008
CN 204156172 U 2/2015
CN 103311695 B 1/2016
CN 104124549 B 11/2016
CN 206283019 U 6/2017

* cited by examiner

ELECTRICAL CONNECTOR CAPABLE OF IMPROVING HIGH FREQUENCY PERFORMANCE

CROSS-REFERENCE TO RELATED PATENT APPLICATION

This non-provisional application claims priority to and the benefit of, pursuant to 35 U.S.C. § 119(a), patent application Serial No. CN 201810119115.0 filed in China on Feb. 6, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector which has terminals capable of improving the high frequency performance.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventionally known Land Grid Array (LGA) type electrical connector has multiple conductive terminals for electrically connecting a chip module to a circuit board. The conductive terminal basically includes a base portion, an elastic arm and a conducting portion. The base portion is flat plate shaped. The elastic arm is formed by extending upward from the base portion and is configured to abut the chip module. The conducting portion is formed by extending downward from the base portion and is configured to be electrically connected to the circuit board through a solder. With the development of technology, the transmission frequency of signals is further increased. Impedance of the conventionally known conductive terminal structure may be difficult to achieve impedance match when high-frequency signals are transmitted, which easily causes high-frequency resonance and generates high-frequency noise, thereby having difficulties to satisfy the performance demand of transmitting high-frequency signals. Therefore, a heretofore unaddressed need to design a novel electrical connector exists in the art to address the aforementioned deficiencies and inadequacies.

SUMMARY

The invention is directed to an electrical connector having conductive terminals for improving the high frequency performance by adjusting the impedance of the terminals.

To achieve the foregoing objective, the invention adopts the following technical solutions.

An electrical connector configured to electrically connect a chip module to a circuit board includes: a body, having a plurality of accommodating slots; and a plurality of conductive terminals, correspondingly accommodated in the accommodating slots. Each of the conductive terminals includes: a base portion; an elastic arm, formed by extending upward from the base portion and configured to abut the chip module; a strip connecting portion, formed by extending upward from the base portion and configured to be connected to a strip; an extending portion, formed by bending and extending from one side of the base portion, wherein the extending portion is located below the strip connecting portion and does not interfere with a corresponding one of the accommodating slots; and a conducting portion, configured to be electrically connected to the circuit board.

Compared with the related art, certain embodiments of the present invention have the following beneficial effects:

The extending portion is formed by bending and extending the base portion to increase the self-capacitance of the conductive terminal, thereby reducing the impedance of the conductive terminal, and facilitating impedance match between the conductive terminal and the chip module and the circuit board, so as to improve the high frequency performance of the electrical connector. The extending portion is not in contact with the corresponding accommodating slot, thus preventing the extending portion from being deformed due to touching the body. The extending portion is located below the strip connecting portion, and space occupied by the conductive terminal is fully utilized.

An electrical connector configured to electrically connect a chip module to a circuit board includes: a body, having a plurality of accommodating slots; and a plurality of conductive terminals, correspondingly accommodated in the accommodating slots. Each of the conductive terminals includes: a base portion, being flat plate shaped; an elastic arm and a strip connecting portion, respectively formed by extending upward from different locations on an upper edge of the base portion, wherein the elastic arm is configured to abut the chip module, and the strip connecting portion is configured to be connected to a strip; an extending portion, formed by bending and extending from one side of the base portion, wherein the extending portion is located below the strip connecting portion; and a conducting portion, configured to be electrically connected to the circuit board.

Compared with the related art, certain embodiments of the present invention have the following beneficial effects:

The extending portion is formed by bending and extending the base portion to increase the self-capacitance of the conductive terminal, thereby reducing the impedance of the conductive terminal, and facilitating impedance match between the conductive terminal and the chip module and the circuit board, so as to improve the high frequency performance of the electrical connector. The extending portion is located below the strip connecting portion, and space occupied by the conductive terminal is fully utilized.

An electrical connector configured to electrically connect a chip module to a circuit board includes: a body, having a plurality of accommodating slots; and a plurality of conductive terminals, correspondingly accommodated in the accommodating slots. Each of the conductive terminals includes: a base portion; an elastic arm, formed by extending upward from the base portion and configured to abut the chip module; a strip connecting portion, formed by extending upward from the base portion and configured to be connected to a strip; an extending portion, formed by bending and extending from one side of the base portion, and forming an included angle with the base portion, wherein the extending portion is located below the strip connecting portion; and a conducting portion, configured to be electrically connected to the circuit board, wherein each of the accommodating slots has two opposite first side walls, and two opposite plate surfaces of the base portion of the corresponding one of the conductive terminals and the two first side walls of each of the accommodating slots are correspondingly provided at intervals.

Compared with the related art, certain embodiments of the present invention have the following beneficial effects:

The extending portion is formed by bending and extending the base portion to increase the self-capacitance of the conductive terminal, thereby reducing the impedance of the conductive terminal, and facilitating impedance match between the conductive terminal and the chip module and the circuit board, so as to improve the high frequency performance of the electrical connector. In addition, a groove for partially accommodating the conductive terminal is additionally formed on the second side wall of the accommodating slot, thereby improving the retaining effect of the body on the conductive terminal. The extending portion is located below the strip connecting portion, and space occupied by the conductive terminal is fully utilized.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
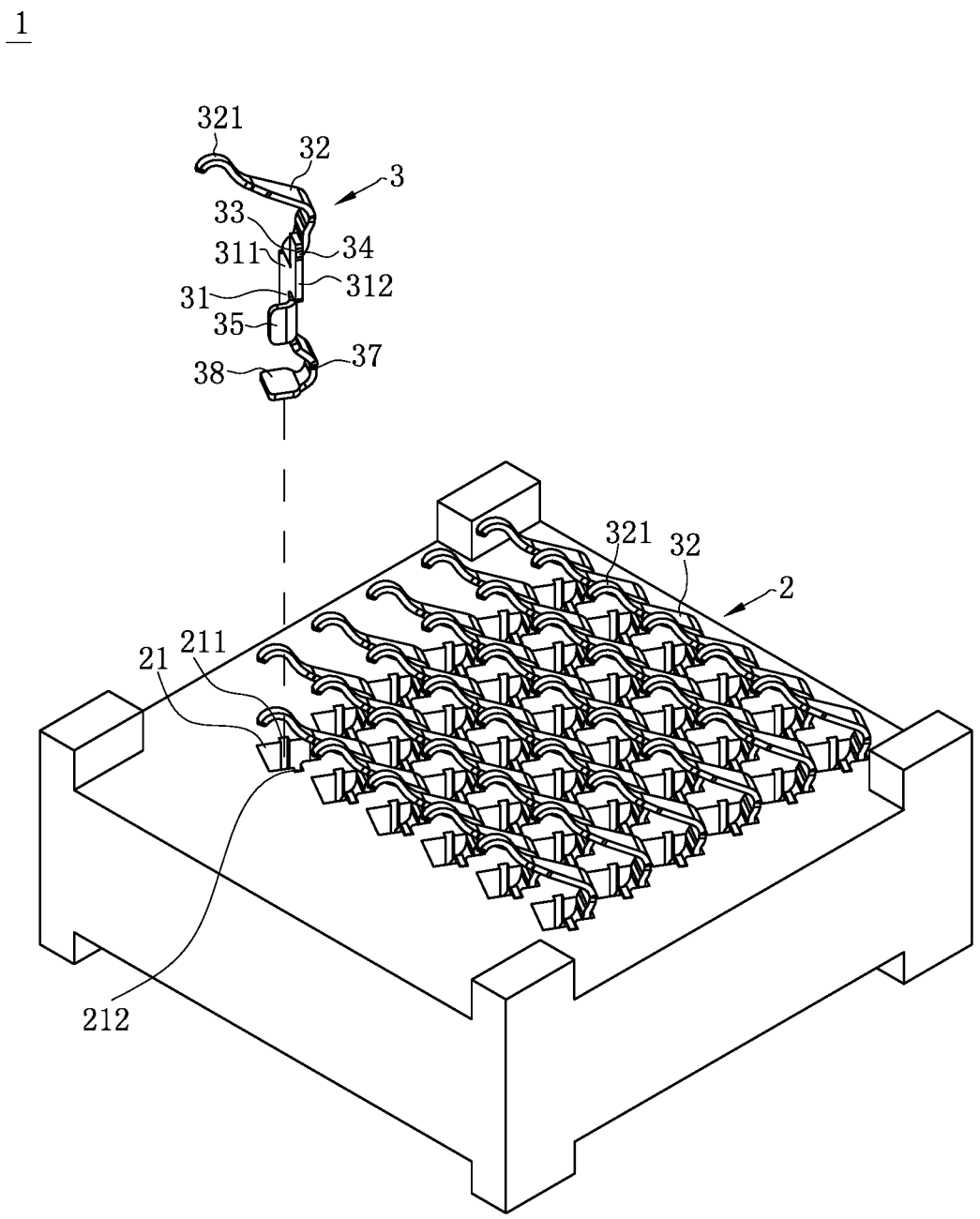
FIG. 1 is a perspective view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-12. In accordance with the purposes of this invention, as embodied and broadly described herein, this invention, in one aspect, relates to an electrical connector.

Referring to FIG. 1 to FIG. 7, which shows an electrical connector 1 according to a first embodiment of according to the present invention, the electrical connector 1 is configured to electrically connect a chip module 4 to a circuit board 5. The electrical connector 1 includes a body 2, and multiple conductive terminals 3 provided in the body 2. An upper end of each of the conductive terminals 3 elastically abuts the chip module 4, and a lower end of each of the conductive terminals 3 is soldered to the circuit board 5 through a solder 6.

Figure 5:
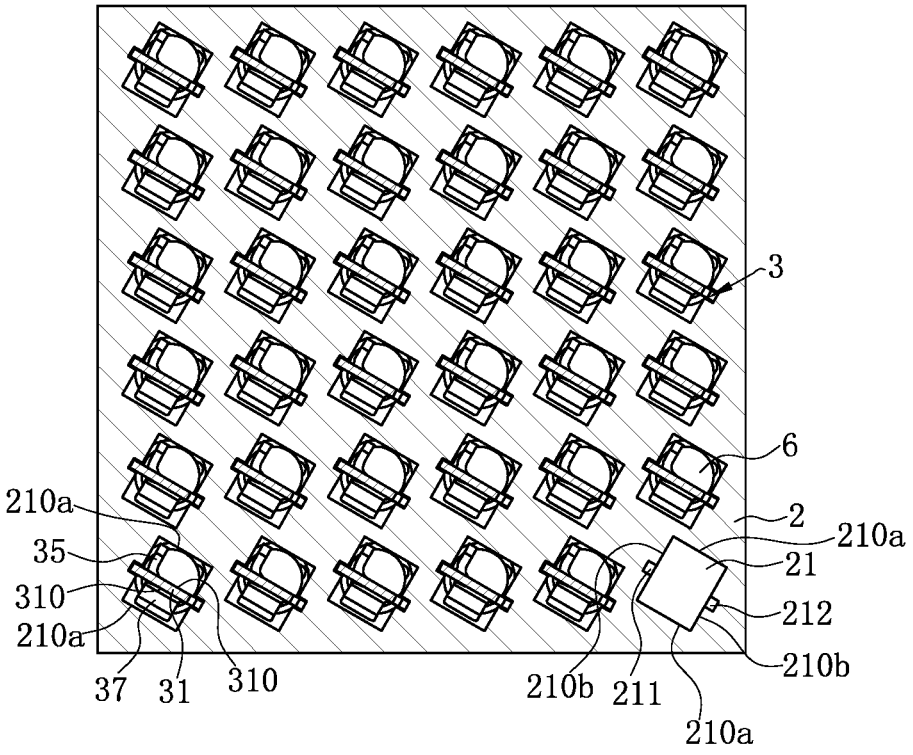
FIG. 5 is a transversal sectional view of FIG. 1.

Referring to FIG. 1 and FIG. 5, the body 2 is made from an insulating material, and is provided with multiple accommodating slots 21 arranged in a matrix and running through the body 2 vertically. Referring to FIG. 5, each of the accommodating slots 21 has two opposite first side walls 210*a* and two opposite second side walls 210*b*, and each accommodating slot 21 has a first groove 211 and a second groove 212. The first groove 211 and the second groove 212 are located in roughly middle positions of two opposite second side walls 210*b* of the accommodating slot 21, are concavely formed on the two opposite second side walls 210*b* of the accommodating slot 21, and are symmetrical about the accommodating slot 21 to be configured to accommodate a corresponding conductive terminal 3, such that the corresponding conductive terminal 3 is retained in the body 2.

Figure 4:
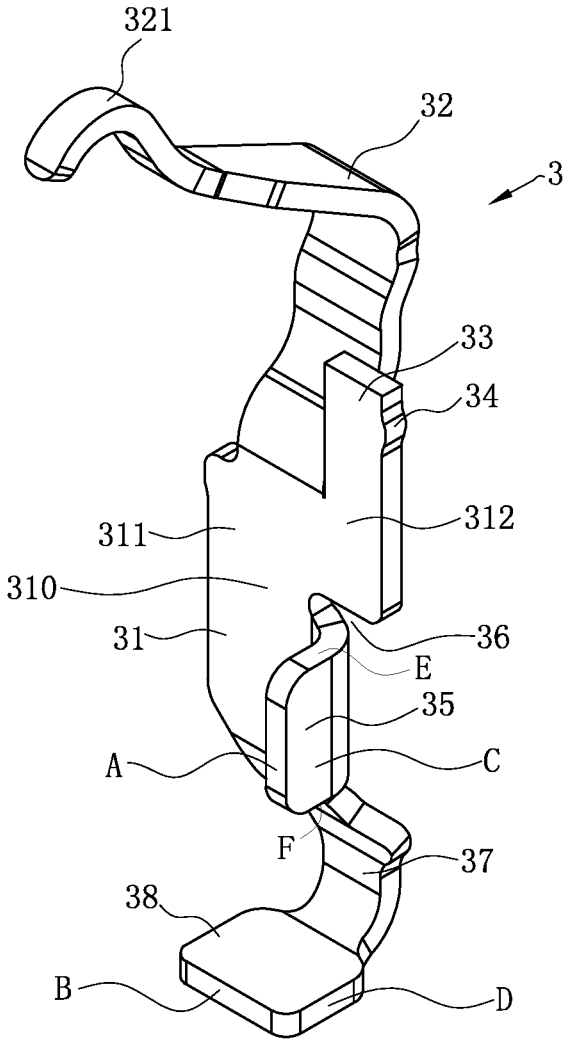
FIG. 4 is a perspective view of a conductive terminal in FIG. 1.
Figure 6:
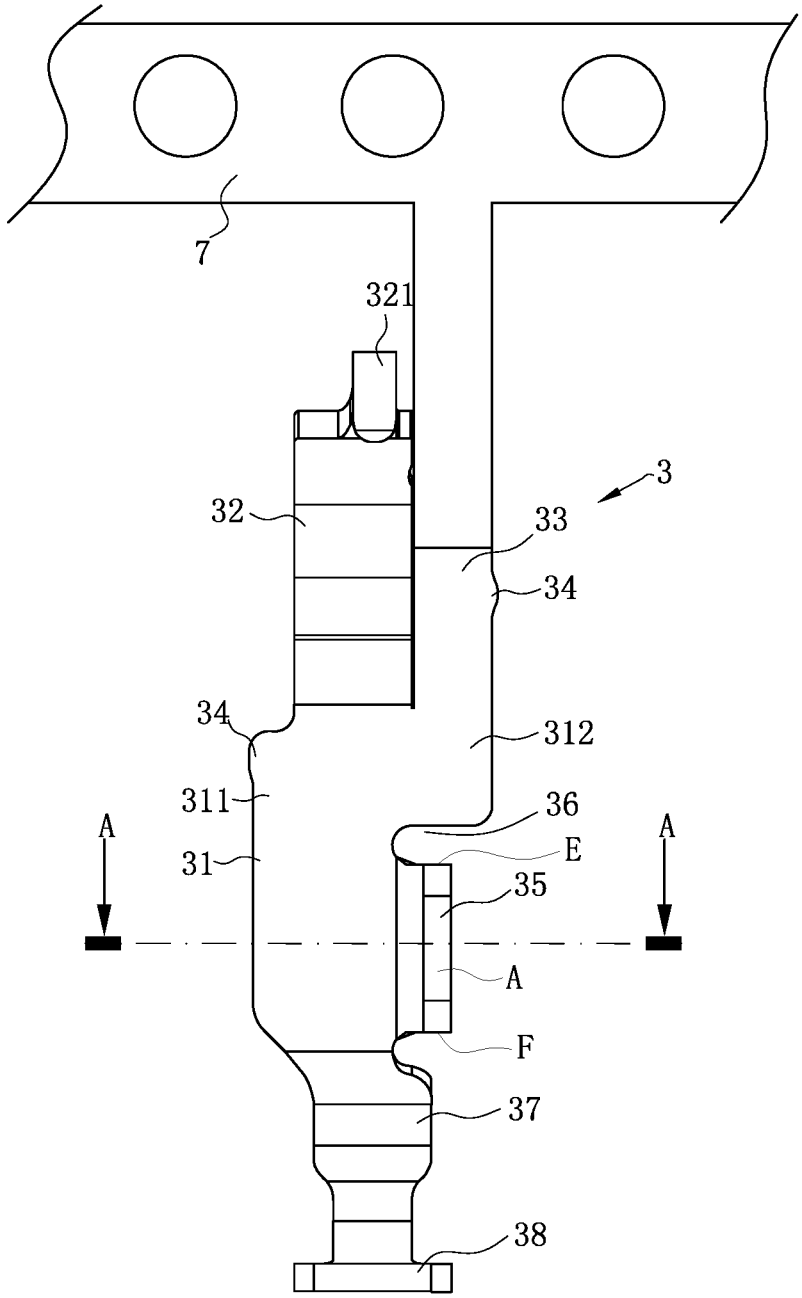
FIG. 6 is a front view of FIG. 4.

Referring to FIG. 4 and FIG. 6, each conductive terminal 3 is formed by punching a metal sheet, and includes a base portion 31 being flat plate shaped. The base portion 31 includes a main portion 311 and a protruding portion 312 formed by extending from one side of the main portion 311, and the protruding portion 312 and the main portion 311 are on the same plane. An elastic arm 32 is formed by bending and extending upward from an upper edge of the main portion 311. The elastic arm 31 firstly extends in one direction far away from a vertical plane where the base portion 31 is located, and then inversely bends and extends to pass beyond the vertical plane where the base portion 31 is positioned above the main portion 311. The elastic arm 32 has an arc-shaped contact portion 321 for abutting the chip module 4. A strip connecting portion 33 is formed by extending upward from an upper edge of the protruding portion 312, and is on the same plane with the base portion 31. The strip connecting portion 33 is configured to be connected to a strip 7. The elastic arm 32 and the strip connecting portion are formed by tearing. Compared with conventional blanking molding, tearing of the elastic arm 32 and the strip connecting portion 33 enables a spacing distance between the elastic arm 32 and the strip connecting portion 33 to be smaller, thus reducing the space occupied by the conductive terminal 3, and allowing more conductive terminals 3 to be arranged on the body 2. The strip connecting portion 33 is partially accommodated in the first groove 211, and the main portion 311 is partially accommodated in the second groove 212, such that two opposite plate surfaces 310 of the base portion 31 and the two opposite first side walls 210*a* of the accommodating slot 21 are respectively provided at intervals. Each of a side edge of the strip connecting portion 33 and a side edge of the base portion 31 is respectively provided with a protrusion 34, and the two protrusions 34 correspondingly interfere with walls of both the first groove 211 and the second groove 212, such that the conductive terminal 3 is retained in the body 2.

Figure 3:
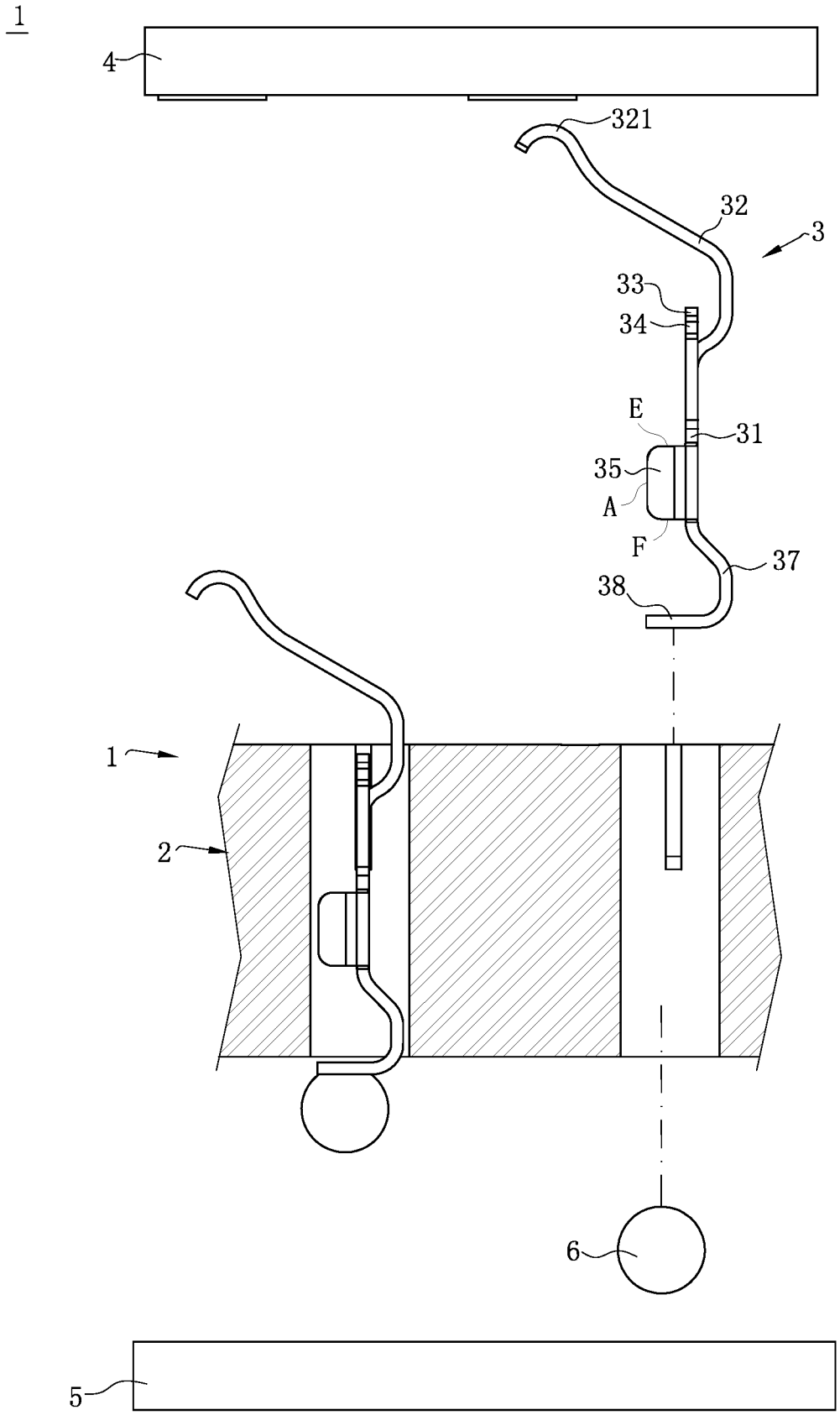
FIG. 3 is an exploded view of FIG. 2.

Referring to FIG. 4 and FIG. 6, compared with the related art, each conductive terminal 3 of the present embodiment particularly includes an extending portion 35, which is formed by bending forward and extending from one side of the main portion 311 and is perpendicular to the base portion 31. (That is, an included angle between the extending portion 35 and the base portion 31 is 90 degrees. In other embodiments, the included angle between the extending portion 35 and the base portion 31 can be other angles.) The extending portion 35 and the protruding portion 312 are located at the same side of the main portion 311, and the extending portion 35 is located below the protruding portion 312 and the strip connecting portion 33. A spacing groove 36 is also provided between the extending portion 35 and the protruding portion 312, so as to facilitate bending of the extending portion 35. In an extending direction of the protruding portion 312, the protruding portion 312 extends beyond the extending portion 35, so as to increase the utility ratio of each of the conductive terminals 3 on the metal sheet. Specifically, the extending portion 35 includes an upper side edge E, a lower side edge F and a front side edge A connecting the upper side edge E and the lower side edge F. The front side edge A forms a free end of the extending portion 35. The upper side edge E is located below the strip connecting portion 33. Referring to FIG. 3 and FIG. 5, the extending portion 35 does not interfere with the body 2, so as to prevent the extending portion 35 from being deformed due to touching the body 2. Further, the extending portion 35 is not in contact with the chip module 4 and the circuit board 5. Moreover, in each of the conductive terminals 3, the upper side edge E, the lower side edge F and the front side edge A of the extending portion 35 are not connected to other components of the conductive terminal 3.

Figure 2:
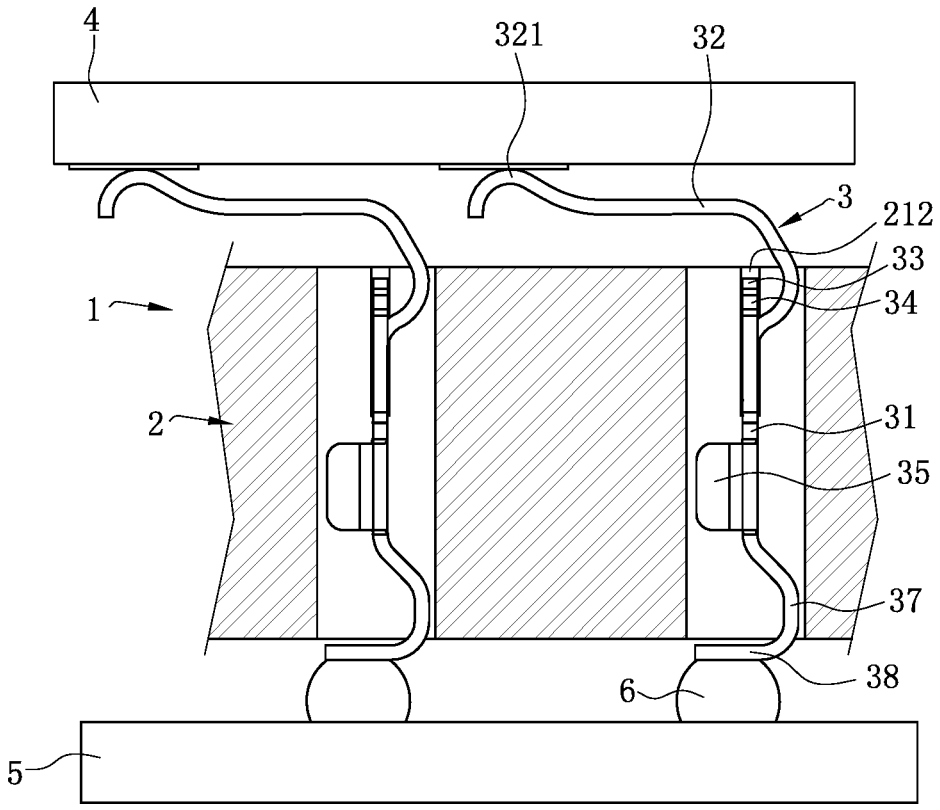
FIG. 2 is a longitudinal sectional view of FIG. 1, where the electrical connector is assembled between a chip module and a circuit board.
Figure 7:
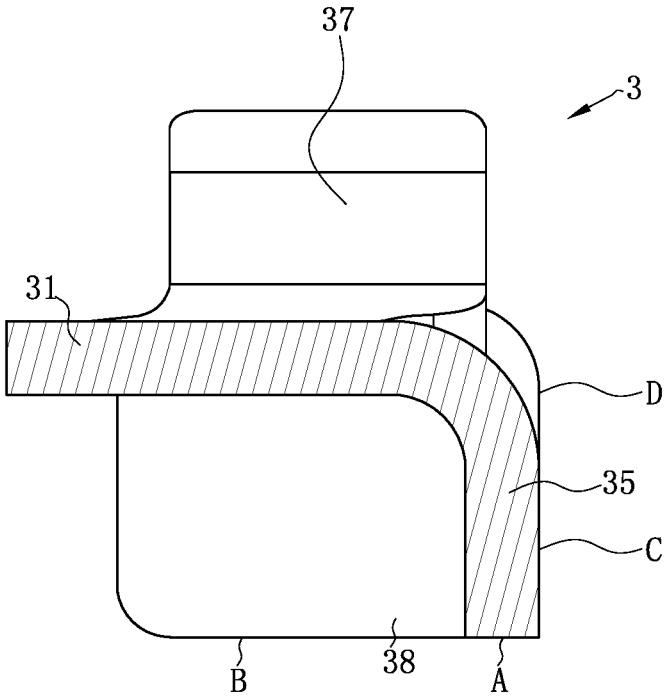
FIG. 7 is a sectional view of FIG. 6 along a line A-A.

Referring to FIG. 2 and FIG. 4, each conductive terminal 3 also has a bending portion 37 and a conducting portion 38. The bending portion 37 is formed by bending and extending downward from the main portion 311. The conducting portion 38 is flat plate shaped and horizontally provided at an end of the bending portion 37, and is soldered to the circuit board 5 through the solder 6. The lower side edge F of the extending portion 35 is located above the conducting portion 38. Referring to FIG. 7, a free end A of the extending portion 35 is flush with a free end B of the conducting portion 38 in a vertical direction, a side surface C of the extending portion 35 is flush with a side edge D of the conducting portion 38 in a vertical direction, and a projection of the conducting portion 38 and a projection of the extending portion 35 in a vertical direction at least partially overlap so as to reduce an occupied area of the conductive terminal 3 on the horizontal plane, such that the body 2 can accommodate more conductive terminals 3.

Figure 8:
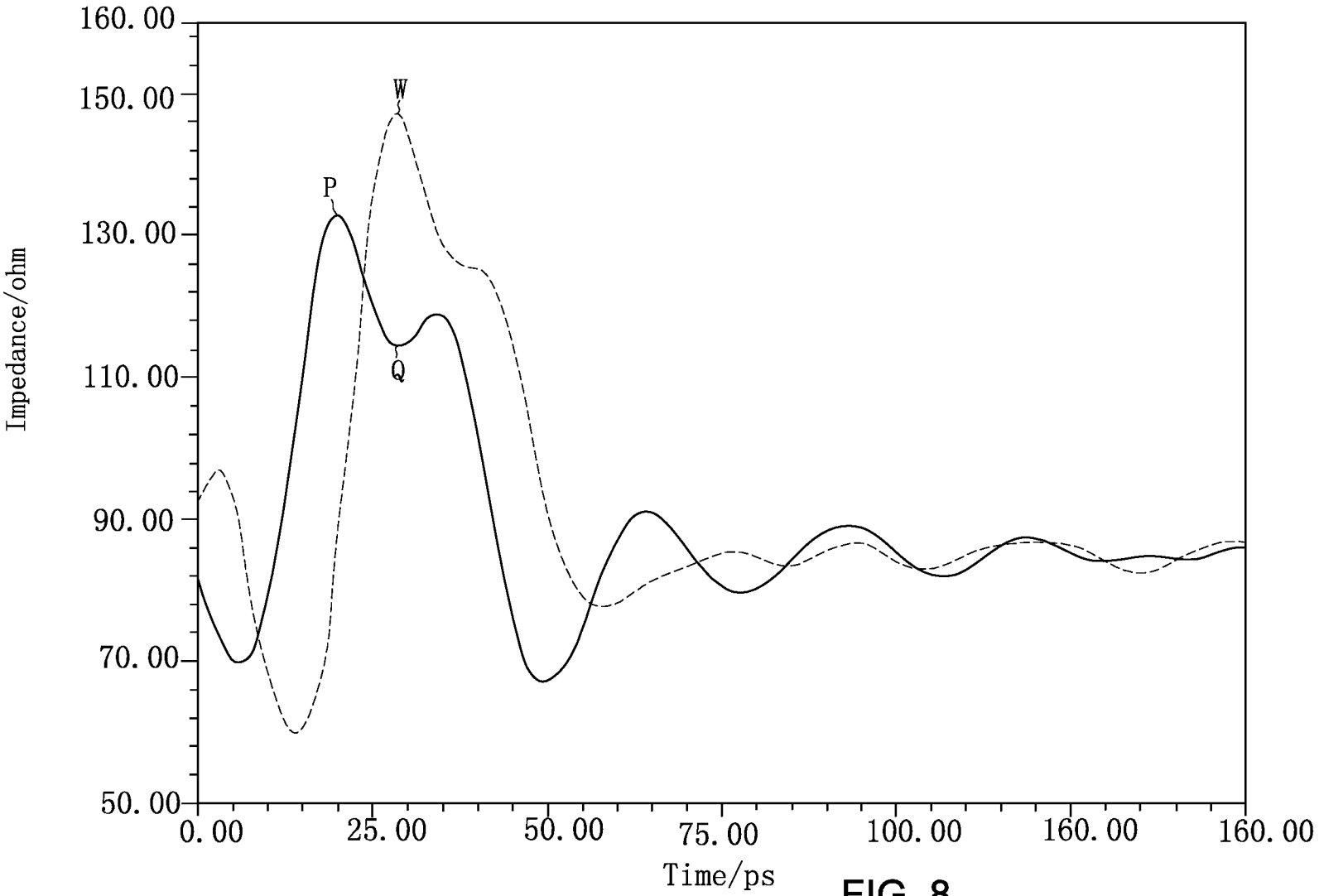
FIG. 8 is a diagram showing an impedance curve of FIG. 4 and an impedance curve of a conductive terminal without an extending portion.
Figure 9:
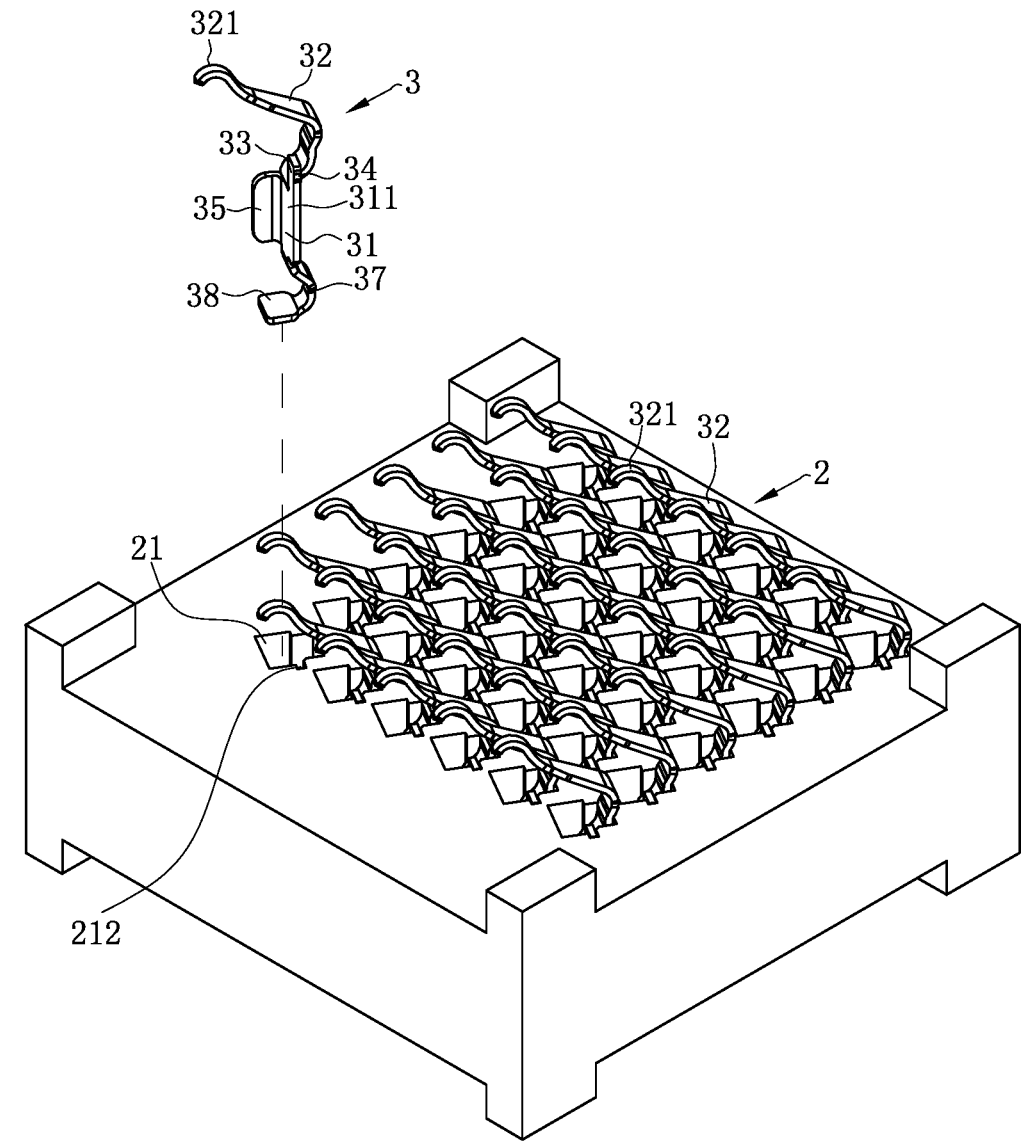
FIG. 9 is a perspective view of an electrical connector according to a second embodiment of the present invention.
Figure 10:
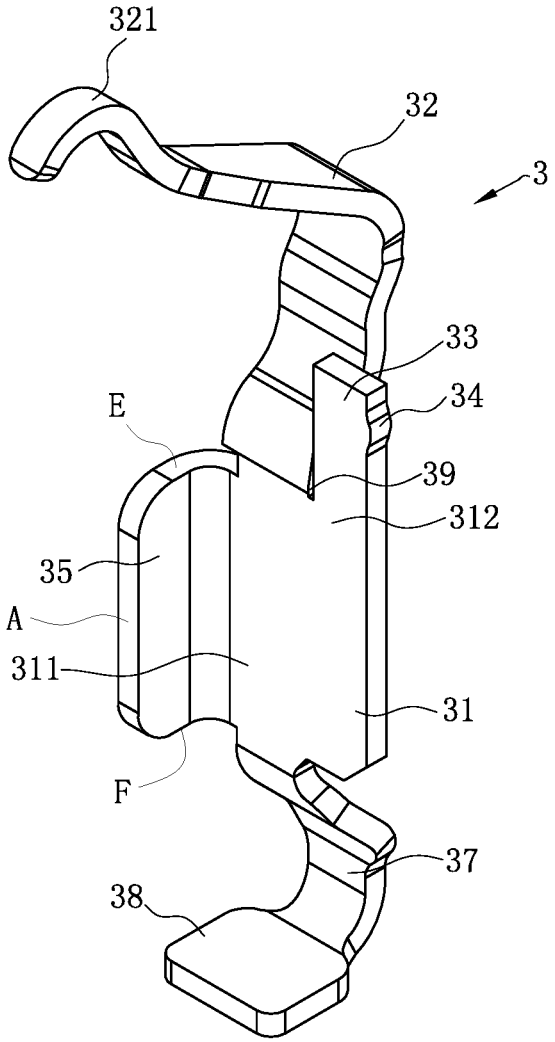
FIG. 10 is a perspective view of a conductive terminal in FIG. 9.

Referring to FIG. 8, in a diagram showing an impedance curve of the conductive terminal 3 in the electrical connector 1 according to the first embodiment of the present invention and an impedance curve of the conductive terminal without the extending portion 35, the horizontal axis coordinate represents conduction time in picoseconds (ps), and the longitudinal axis coordinate represents impedance of the conductive terminal in ohm. A solid curve is a change curve representing the change of the impedance of the conductive terminal 3 as the conduction time increases when current flows through the conductive terminal 3. A dotted curve is a change curve representing the change of the impedance of the conductive terminal without the extending portion 35 as the conduction time increases when the current flows through the conductive terminal without the extending portion 35. The extending portion 35 functions to increase the volume and cross-sectional area of the conductive terminal 3, so as to increase self-capacitance of the conductive terminal 3, such that a trough Q is formed in the solid curve at about 27.5 ps, and a peak W is formed in the dotted curve at about 27.5 ps. Apparently, the peak W is the highest point of the dotted curve, and the peak W is higher than the trough Q and the highest point P of the solid curve. That is, the maximum impedance of the conductive terminal 35 without the extending portion 35 is greater than the maximum impedance of the conductive terminal 3. Conversely, the extending portion 35 is provided to reduce the impedance of the conductive terminal 3, thereby facilitating impedance match between the conductive terminal 3 and the chip module 4 and the circuit board 5, so as to improve the high frequency performance of the electrical connector 1.

Referring to FIG. 9 to FIG. 12, an electrical connector 1 according to a second embodiment of the present invention is shown. Comparing to the first embodiment, the difference in this embodiment exists in that the extending portion 35 and the strip connecting portion 33 are respectively located at two sides of the elastic arm 32, while in the first embodiment, the extending portion 35 and the strip connecting portion 33 are located at the same side of the elastic arm 32. In addition, the length of the extending portion 35 is roughly equal to the length of the base portion 31 in a vertical direction. In other embodiments, the length of the extending portion 35 may be smaller than the length of the base portion 31. The volume and the cross-sectional area of the conductive terminal 3 are changed by changing the length of the extending portion 35 in the vertical direction, so as to adjust the self-capacitance and the impedance of the conductive terminal 3 to achieve impedance match.

Figure 11:
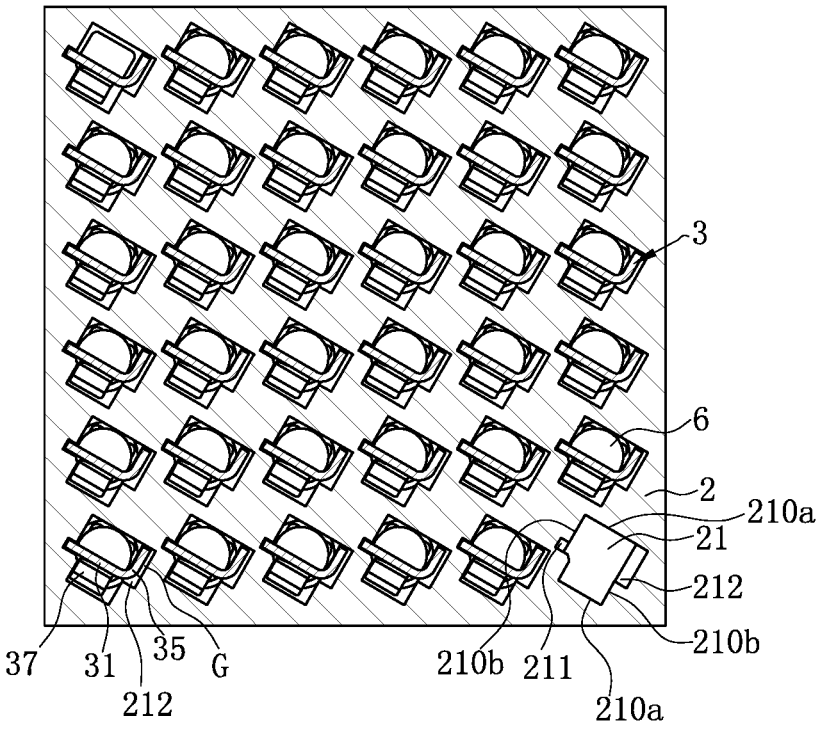
FIG. 11 is a transversal sectional view of FIG. 9.

Referring to FIG. 11, the first groove 211 and the second groove 212 are not symmetrical. The second groove 212 extends to one of the two first side walls 210*a* to be used for accommodating the extending portion 35, and a gap G is provided between the extending portion 35 and each of side surfaces of the second groove 212, such that the extending portion 35 does not interfere and contact with the body 2 so as to prevent the extending portion 35 from being deformed due to touching the body 2.

Figure 12:
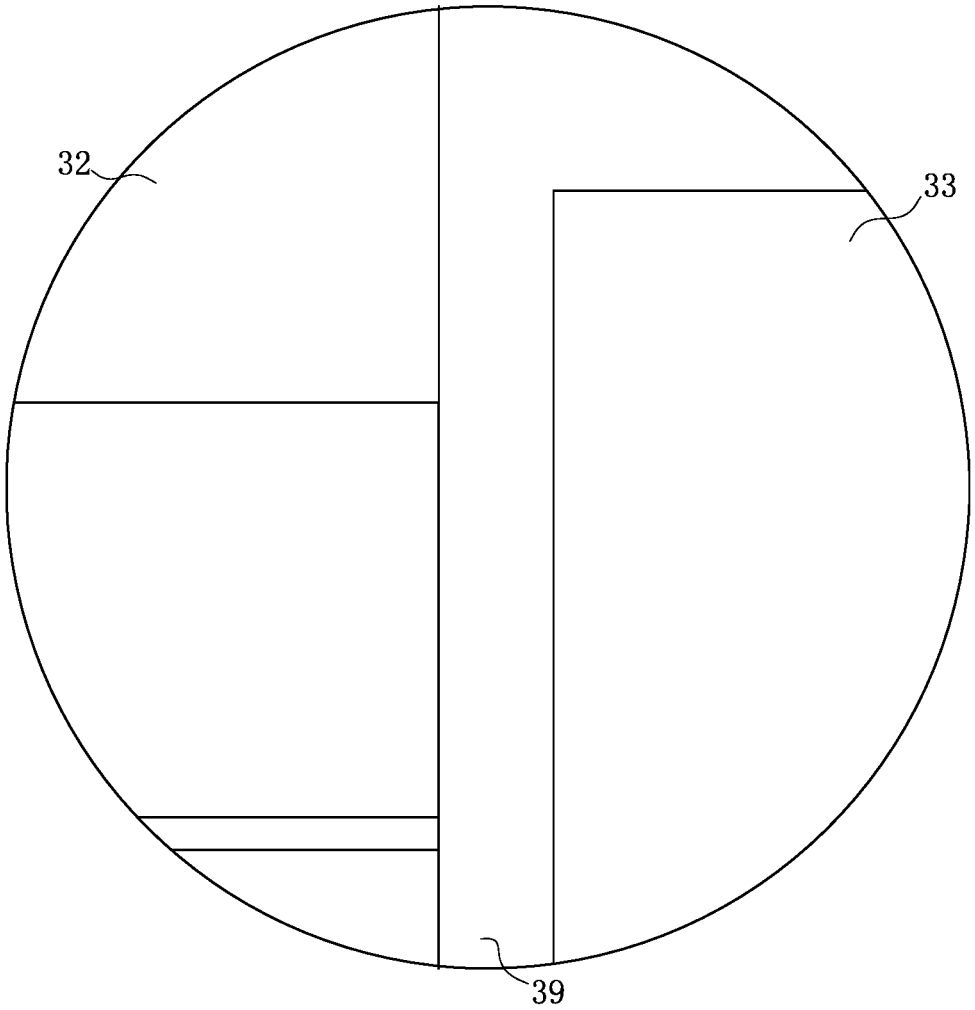
FIG. 12 is a partial enlarged view of a front view of FIG. 10.

Referring to FIG. 12, in the present embodiment, when the elastic arm 32 is not folded such that the elastic arm 32 and the strip connecting portion 33 are provided on a same plane, a process groove 39 is formed therebetween. That is, blanking is carried out between the elastic arm 32 and the strip connecting portion 33, thereby facilitating molding of the conductive terminal 3 compared with tearing.

To sum up, the electrical connector according to certain embodiments of the present invention has the following beneficial effects:

1. The volume and the cross-sectional area of the conductive terminal 3 are increased by the extending portion 35, so as to increase the self-capacitance of the conductive terminal 3 and reduce the impedance of the conductive terminal 3 in a specific conductive time-domain, thereby facilitating the impedance match between the conductive terminal 3 and the chip module 4 and the circuit board 5 to improve the high frequency performance of the electrical connector 1.

2. The extending portion 35 does not interfere with the body 2, so as to prevent the extending portion 35 from being deformed by touching the body 2.

3. The extending portion 35 extends laterally by a distance less than a lateral extending distance of the protruding portion 312, and the projections of the extending portion 35 and the conducting portion 38 on the horizontal plane at least partially overlap to reduce the occupied area of the conductive terminal 3 in the vertical direction, such that more conductive terminals 3 can be accommodated in the body 2 of the same size.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector configured to electrically connect a chip module to a circuit board, comprising:

a body, having a plurality of accommodating slots; and a plurality of conductive terminals, correspondingly accommodated in the accommodating slots, wherein each of the conductive terminals comprises:

a base portion;

an elastic arm, formed by extending upward from the base portion and configured to abut the chip module;

a strip connecting portion, formed by extending upward from the base portion and configured to be connected to a strip;

an extending portion, formed by bending forward and extending from one side of the base portion, wherein the extending portion comprises an upper side edge, a lower side edge and a front side edge connecting the upper side edge and the lower side edge, the upper side edge is located below the strip connecting portion, and the extending portion does not interfere with walls of a corresponding one of the accommodating slots and is not in contact with the chip module and the circuit board; and a conducting portion, configured to be electrically connected to the circuit board, wherein the lower side edge of the extending portion is located above the conducting portion, wherein the upper side edge, the lower side edge and the front side edge of the extending portion of a respective conductive terminal of the conductive terminals are not connected to other components of the respective conductive terminal.

2. The electrical connector according to claim 1, wherein the base portion comprises a main portion and a protruding portion, the protruding portion and the extending portion are formed by extending from a same side of the main portion, the elastic arm is formed by extending upward from the main portion, the strip connecting portion is formed by extending upward from the protruding portion, and a spacing groove is arranged between the extending portion and the protruding portion.

3. The electrical connector according to claim 1, wherein the base portion comprises a main portion and a protruding portion, the protruding portion and the extending portion are formed by extending from a same side of the main portion, the elastic arm is formed by extending upward from the main portion, the strip connecting portion is formed by extending upward from the protruding portion, and the protruding portion extends beyond the extending portion in an extending direction of the protruding portion.

4. The electrical connector according to claim 1, wherein the extending portion is perpendicular to the base portion.

5. The electrical connector according to claim 1, wherein a projection of the conducting portion and a projection of the extending portion at least partially overlap in a vertical direction.

6. The electrical connector according to claim 1, wherein the extending portion and the conducting portion extend toward a same direction relative to the base portion, and a free end of the extending portion is flush with a free end of the conducting portion in a vertical direction.

7. The electrical connector according to claim 1, wherein a side surface of the extending portion is flush with a side edge of the conducting portion in a vertical direction.

8. The electrical connector according to claim 1, wherein each of the accommodating slots has a first groove and a second groove concavely formed on two opposite side walls of the accommodating slot, the strip connecting portion is partially accommodated in the first groove, and the base portion is partially accommodated in the second groove.

9. The electrical connector according to claim 1, wherein each of the accommodating slots has a first groove and a second groove concavely formed on two opposite side walls of the accommodating slot, the strip connecting portion is partially accommodated in the first groove, the extending portion is accommodated in the second groove, and a gap is provided between the extending portion and each of side surfaces of the second groove.

10. An electrical connector configured to electrically connect a chip module to a circuit board, comprising:

a body, having a plurality of accommodating slots; and a plurality of conductive terminals, correspondingly accommodated in the accommodating slots, wherein each of the conductive terminals comprises:

a base portion, being flat plate shaped;

an elastic arm and a strip connecting portion, respectively formed by extending upward from different locations on an upper edge of the base portion, wherein the elastic arm is configured to abut the chip module, and the strip connecting portion is configured to be connected to a strip;

an extending portion, formed by bending forward and extending from one side of the base portion, wherein the extending portion comprises an upper side edge, a lower side edge and a front side edge connecting the upper side edge and the lower side edge, the upper side edge is located below the strip connecting portion, and the extending portion is not in contact with the chip module and the circuit board; and a conducting portion, configured to be electrically connected to the circuit board, wherein the lower side edge of the extending portion is located above the conducting portion, wherein the upper side edge, the lower side edge and the front side edge of the extending portion of a respective conductive terminal of the conductive terminals are not connected to other components of the respective conductive terminal.

11. The electrical connector according to claim 10, wherein each of the accommodating slots has a first groove and a second groove concavely formed on two opposite side walls of the accommodating slot, the strip connecting portion is partially accommodated in the first groove, the extending portion is accommodated in the second groove, and a gap is provided between the extending portion and each of side surfaces of the second groove.

12. The electrical connector according to claim 10, wherein the extending portion and the strip connecting portion are respectively located at two sides of the elastic arm.

13. The electrical connector according to claim 10, wherein the extending portion and the conducting portion extend toward a same direction relative to the base portion, and a free end of the extending portion is flush with a free end of the conducting portion in a vertical direction.

14. The electrical connector according to claim 10, wherein a side surface of the extending portion is flush with a side edge of the conducting portion in a vertical direction.

15. An electrical connector configured to electrically connect a chip module to a circuit board, comprising:

a body, having a plurality of accommodating slots; and a plurality of conductive terminals, correspondingly accommodated in the accommodating slots, wherein each of the conductive terminals comprises:

a base portion;

an elastic arm, formed by extending upward from the base portion and configured to abut the chip module;

a strip connecting portion, formed by extending upward from the base portion and configured to be connected to a strip;

an extending portion, formed by bending forward and extending from one side of the base portion, and forming an included angle with the base portion, wherein the extending portion comprises an upper side edge, a lower side edge and a front side edge connecting the upper side edge and the lower side edge, the upper side edge is located below the strip connecting portion, and the extending portion is not in contact with the chip module and the circuit board; and a conducting portion, configured to be electrically connected to the circuit board, wherein the lower side edge of the extending portion is located above the conducting portion, wherein the upper side edge, the lower side edge and the front side edge of the extending portion of a respective conductive terminal of the conductive terminals are not connected to other components of the respective conductive terminal; and wherein each of the accommodating slots has two opposite first side walls, and two opposite plate surfaces of the base portion of the corresponding one of the conductive terminals and the two first side walls of each of the accommodating slots are correspondingly provided at intervals.

16. The electrical connector according to claim 15, wherein each of the accommodating slots has a first groove and a second groove concavely formed on two opposite side walls of the accommodating slot, the strip connecting portion is partially accommodated in the first groove, the extending portion is accommodated in the second groove, and a gap is provided between the extending portion and each of side surfaces of the second groove.

17. The electrical connector according to claim 15, wherein the extending portion and the strip connecting portion are respectively located at two sides of the elastic arm.

18. The electrical connector according to claim 15, wherein the extending portion and the conducting portion extend toward a same direction relative to the base portion, and a free end of the extending portion is flush with a free end of the conducting portion in a vertical direction.

19. The electrical connector according to claim 15, wherein a side surface of the extending portion is flush with a side edge of the conducting portion in a vertical direction.

20. The electrical connector according to claim 15, wherein the base portion comprises a main portion and a protruding portion, the protruding portion and the extending portion are formed by extending from a same side of the main portion, the elastic arm is formed by extending upward from the main portion, the strip connecting portion is formed by extending upward from the protruding portion, and the protruding portion extends beyond the extending portion in an extending direction of the protruding portion.

* * * * *